US006098407A

United States Patent [19]

Korzendorfer et al.

[11] Patent Number: 6,098,407

[45] Date of Patent: Aug. 8, 2000

[54] PREMIXING FUEL INJECTOR WITH IMPROVED SECONDARY FUEL-AIR INJECTION

[75] Inventors: John J. Korzendorfer, West Hartford; Jeffrey D. Melman, Simsbury; Alan J. Goetschius, Marlborough, all of Conn.

[73] Assignee: United Technologies Corporation, Hartford, Conn.

[21] Appl. No.: 09/093,371

[22] Filed: Jun. 8, 1998

[51] Int. Cl.[7] ..... F02C 7/22

[52] U.S. Cl. ..... 60/737; 60/39.32

[58] Field of Search ..... 60/737, 746, 747, 60/740, 39.463, 742, 734, 39.32, 39.33

[56] References Cited

U.S. PATENT DOCUMENTS

| | | | |
|---|---|---|---|
| 2,548,904 | 4/1951 | Neal et al. | 60/44 |
| 2,595,765 | 5/1952 | Clarke et al. | 60/39.65 |
| 2,611,244 | 9/1952 | Clarke et al. | 60/39.71 |
| 2,616,492 | 11/1952 | Sontag | 158/53 |
| 3,159,971 | 12/1964 | Moebius et al. | 60/740 |
| 4,258,544 | 3/1981 | Gebhart et al. | 60/39.32 |
| 4,271,675 | 6/1981 | Jones et al. | 60/737 |
| 5,105,621 | 4/1992 | Simmons et al. | 60/303 |
| 5,165,241 | 11/1992 | Joshi et al. | 60/737 |
| 5,479,773 | 1/1996 | McCoomb et al. | 60/39.32 |
| 5,613,363 | 3/1997 | Joshi et al. | 60/737 |
| 5,735,466 | 4/1998 | Kramer et al. | 239/406 |
| 5,761,897 | 6/1998 | Kramer | 60/39.06 |
| 5,791,562 | 8/1998 | Kramer et al. | 239/399 |
| 5,896,739 | 4/1999 | Snyder et al. | 60/39.06 |
| 5,899,076 | 5/1999 | Snyder et al. | 60/740 |

FOREIGN PATENT DOCUMENTS

| | | |
|---|---|---|
| 80/00593 | 4/1980 | WIPO . |
| 97/34108 | 9/1997 | WIPO . |

OTHER PUBLICATIONS

European Search Report—EP 99 30 4452.

*Primary Examiner*—Timothy S. Thorpe
*Assistant Examiner*—Ehud Gartenberg
*Attorney, Agent, or Firm*—Kenneth C. Baran

[57] ABSTRACT

A premixing, tangential entry fuel injector (10) for a gas turbine engine features a secondary fuel-air injection insert (40) positively secured to a centerbody shell (38) by a braze joint (98). A secondary fuel supply tube (42), positively secured to both a centerbody base (36) and to the insert (40), is curved in at least two dimensions. In an exemplary embodiment, the tube is coiled into a spiral shape covering a single 360° cycle. During engine operation, the centerbody expands axially in response to elevated temperatures in the engine's interior, causing the insert (40) to be displaced away from the base (36). The curvature of the tube allows the tube to flex slightly to accommodate the displacement. Ideally the curvature of the tube is such that the tube's natural frequency is well above the maximum vibratory frequency that the tube will experience during engine operation.

14 Claims, 3 Drawing Sheets

82
88
78
86
64
54
92
86
78
88
94
96
40
98
74
68
84
52
76
56
72
108
62
106
66
58
38
34
22
46
42

PREMIXING FUEL INJECTOR WITH IMPROVED SECONDARY FUEL-AIR INJECTION

CROSS REFERENCE TO RELATED APPLICATIONS

This application includes subject matter related to commonly owned copending U.S. patent applications 08/771,408, now U.S. Pat. No. 5,899,076 entitled "Flame Disgorging Two Stream Tangential Entry Nozzle" filed on Dec. 20, 1996, 08/771,409, now U.S. Pat. No. 5,896,739 entitled "Method of Disgorging Flames from a Two Stream Tangential Entry Nozzle" filed on Dec. 20, 1996, 08/991,032 entitled "Bluff Body Premixing Fuel Injector and Method for Premixing Fuel and Air", filed on Dec. 15, 1997, 09/046,903 entitled "Improved Durability Flame Stabilizing Fuel Injector" filed on Mar. 24, 1998 and 09/080,485 entitled "Premixing Fuel Injector and Method of Operation" filed on May 18, 1998.

TECHNICAL FIELD

This invention is directed to premixing fuel injectors for introducing primary and secondary fuel and air into the combustor of a gas turbine engine, and particularly to a premixing fuel injector having an improved arrangement for transporting and injecting the secondary fuel and air.

BACKGROUND OF THE INVENTION

Industrial gas turbine engines, such as those used for electrical power generation or as industrial powerplants, are subject to stringent regulation of nitrous oxides (NOx) and other undesirable exhaust emissions. In order to minimize these emissions, industrial gas turbines are equipped with premixing fuel injectors that may be of the type known as tangential entry injectors. A typical tangential entry injector features an axially extending centerbody and a pair of arcuate scrolls that extend axially between a forward bulkhead and an aft bulkhead. The scrolls are radially spaced from the centerbody to bound an annular mixing chamber. The scrolls are also radially offset from each other to define a pair of air intake slots, each of which admits a stream of primary combustion air tangentially into the mixing chamber. Each scroll includes an array of axially distributed fuel injection passages for introducing primary fuel into the incoming airstream. The aft bulkhead of the injector includes a discharge port for introducing the primary fuel and air into the engine combustor, and the aftmost extremity of the port defines a fuel injector discharge plane.

The injector centerbody includes a base affixed to the forward bulkhead, an injection insert having a flat aft surface, and a substantially frustoconical hollow shell. The shell extends axially from the base to define both the radially inner extremity of the mixing chamber and the radially outer extremity of a secondary air supply conduit. The injection insert is axially spaced from the base and rests snugly within the aft end of the shell so that its aft, axially facing flat surface is axially aligned with both the trailing edge of the centerbody and with the injector discharge plane. Although the insert and the aft end of the shell are in mutual contact, the insert is fastened only to a secondary fuel supply tube that originates at the base and extends linearly through the conduit. Thus, the insert is supported radially by the aft end of the shell and axially by the secondary fuel supply tube. The absence of a positive connection between the shell and the insert protects the injector from damage by allowing the shell and insert to slide axially relative to each other in response to dissimilar, thermally induced dimensional changes. These dissimilar dimensional changes arise because the centerbody shell can reach temperatures as high as 900° F., but the fuel supply tube is exposed to fuel at a temperature of no more than about 200° F. Consequently the centerbody shell expands considerably in the axial direction but the fuel supply tube expands relatively little in the axial direction.

During engine operation, the primary air and fuel enter the mixing chamber, swirl around the centerbody and become intimately intermixed. The swirling fuel-air mixture flows axially through the mixing chamber, past the injector discharge plane and into the engine combustor where the mixture is ignited and burned. The thoroughly blended fuel-air mixture keeps the combustion flame temperature uniformly low, a prerequisite for NOx suppression, and promotes complete, clean combustion. Concurrently, a stream of secondary air enters the air supply conduit through holes in the base, and a secondary fuel stream flows through the fuel supply tube. The injection insert divides the secondary air and fuel streams into discrete, judiciously distributed jets of air and fuel, and introduces those jets into the combustor. The secondary fuel and air encourage the combustion flame to become anchored to and spatially stabilized by the exposed, aft end of the insert. As a result, the flame resists being ingested into the mixing chamber where it could cause considerable damage. The spatially stabilized flame also minimizes the likelihood of aero-thermal acoustic resonance, a phenomenon associated with spatial instability of the flame, and one that can cause considerable structural damage to the engine. Finally, because the aft face of the insert is axially aligned with the trailing edge of the centerbody, the anchored, spatially stabilized combustion flame burns entirely outside the centerbody, thereby preventing heat related damage to the interior of the centerbody.

Despite the many merits of tangential entry fuel injectors as described above, they are not without potential shortcomings. In particular, the absence of a positive connection between the insert and the shell, while desirable for preventing thermally induced damage, may not be completely satisfactory for extended, trouble free service. The relative sliding motion between the juxtaposed surfaces of the insert and the shell can erode those surfaces and compromise the snug fit between the insert and the shell. As the wear progresses, a narrow annulus develops between the insert and the shell so that the insert is free to vibrate. The vibrating insert can overstress and break the connection between the fuel supply tube and the centerbody base. In addition, a small but unregulated quantity of secondary air leaks through the annulus and may increase exhaust emissions or undermine the ability of the flame to remain anchored to the insert. In addition, if the fuel supply tube breaks anywhere along its length, the insert could be dislodged from the injector with the potential for causing considerable foreign object damage to the engine. Finally, the unequal axial thermal expansion of the shell relative to the fuel supply tube can cause the aft face of the insert to become axially recessed in the shell. The combustion flame, which is anchored to the aftmost surface of the insert, would then be partially recessed into the shell where the flame can cause heat related damage.

What is needed is a premixing fuel injector that accommodates dissimilar dimensional changes of the centerbody shell relative to the secondary fuel tube, exhibits superior durability, resists degradation of its operating characterizes and minimizes the risk of liberated parts and attendant foreign object damage.

SUMMARY OF THE INVENTION

According to the invention, a premixing fuel injector includes a secondary fuel-air injection insert positively secured to the centerbody shell and connected to a fuel supply tube curved in at least two dimensions to accommodate dissimilar dimensional changes. According to one aspect of the invention the fuel supply tube is curved so that its natural frequency exceeds a maximum vibratory frequency that the tube will encounter during engine operation. In one detailed embodiment of the invention, the tube is coiled in a spiral shape that covers approximately one 360° cycle.

The main advantage of the inventive injector is its capacity to accommodate dissimilar dimensional changes without sustaining any appreciable wear due to relative sliding between injector components. Corollary advantages include minimized risk of foreign object damage, and long term survivability of desirable operating characteristics such as low emissions and flame spatial stability.

The foregoing features and advantages and the operation of the invention will become more apparent in light of the following description of the best mode for carrying out the invention and the accompanying drawings.

BEST MODE FOR CARRYING OUT THE INVENTION

Figure 1:
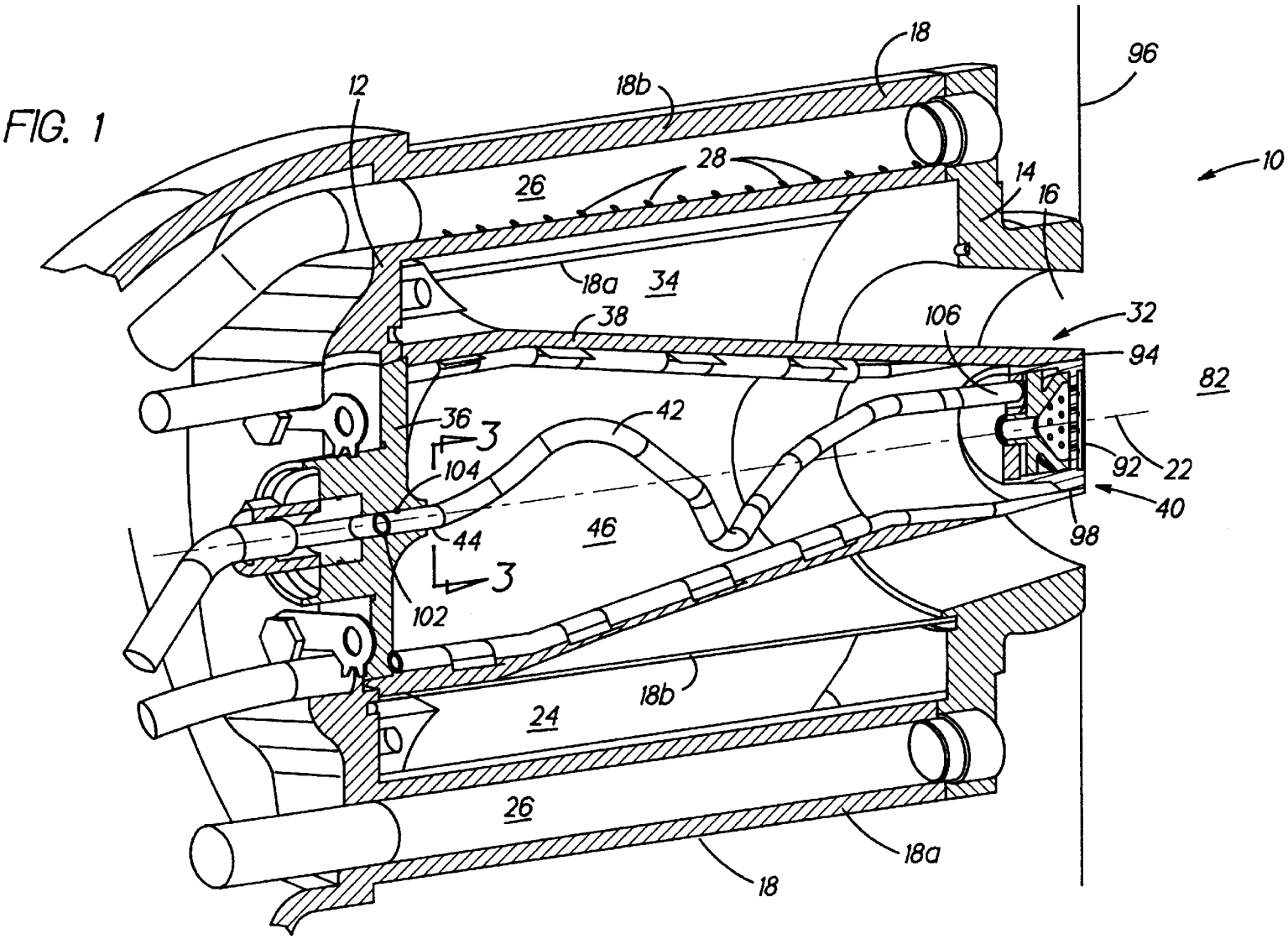
FIG. 1 is a perspective view of a premixing fuel injector for an industrial gas turbine, cutaway to show the injector centerbody including the centerbody shell, the secondary fuel-air injection insert and the secondary fuel supply tube.
Figure 2:
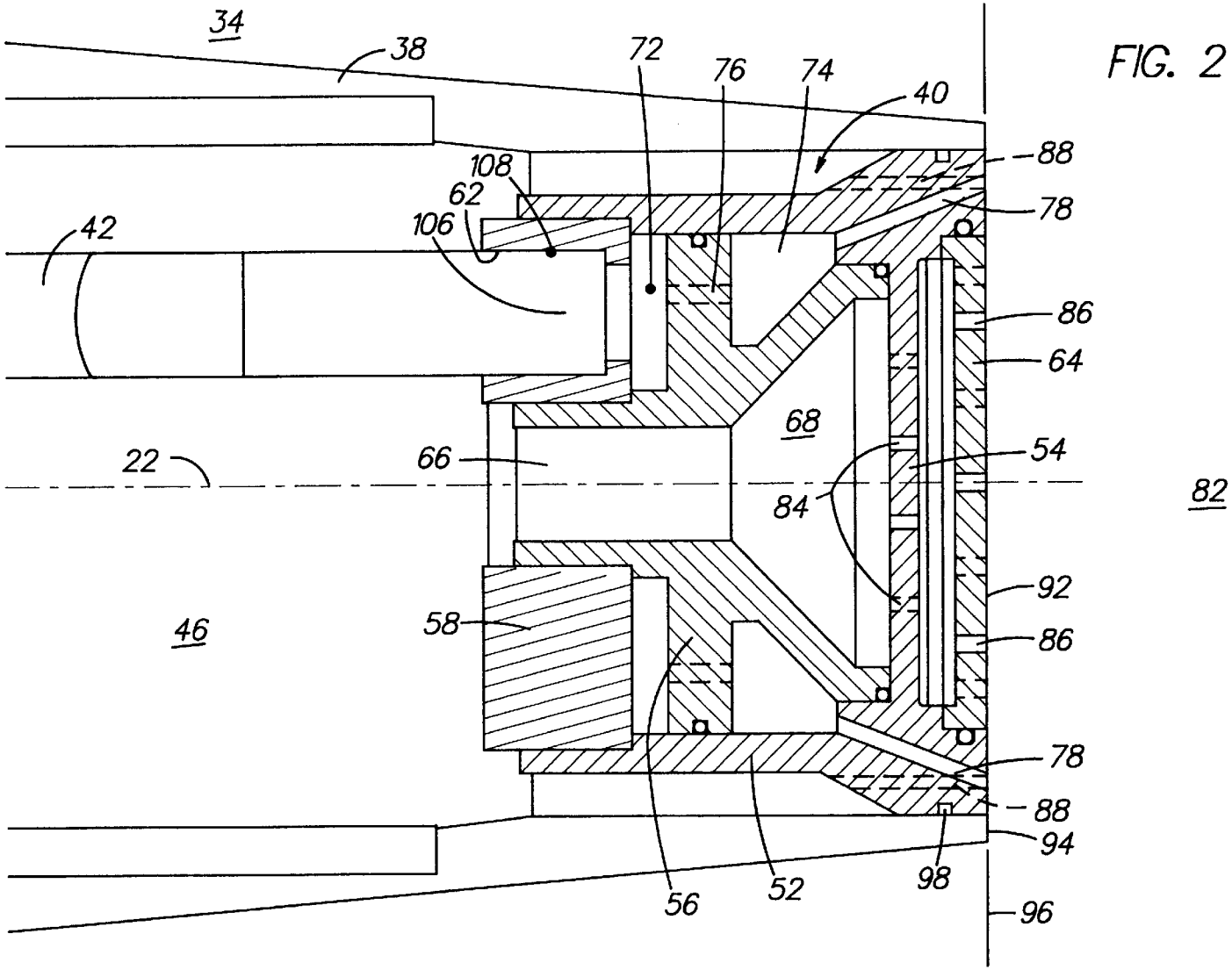
FIG. 2 is an enlarged side view of the aft end of the injector centerbody showing the relationship of the centerbody shell to the fuel-air injection insert.
Figure 3:
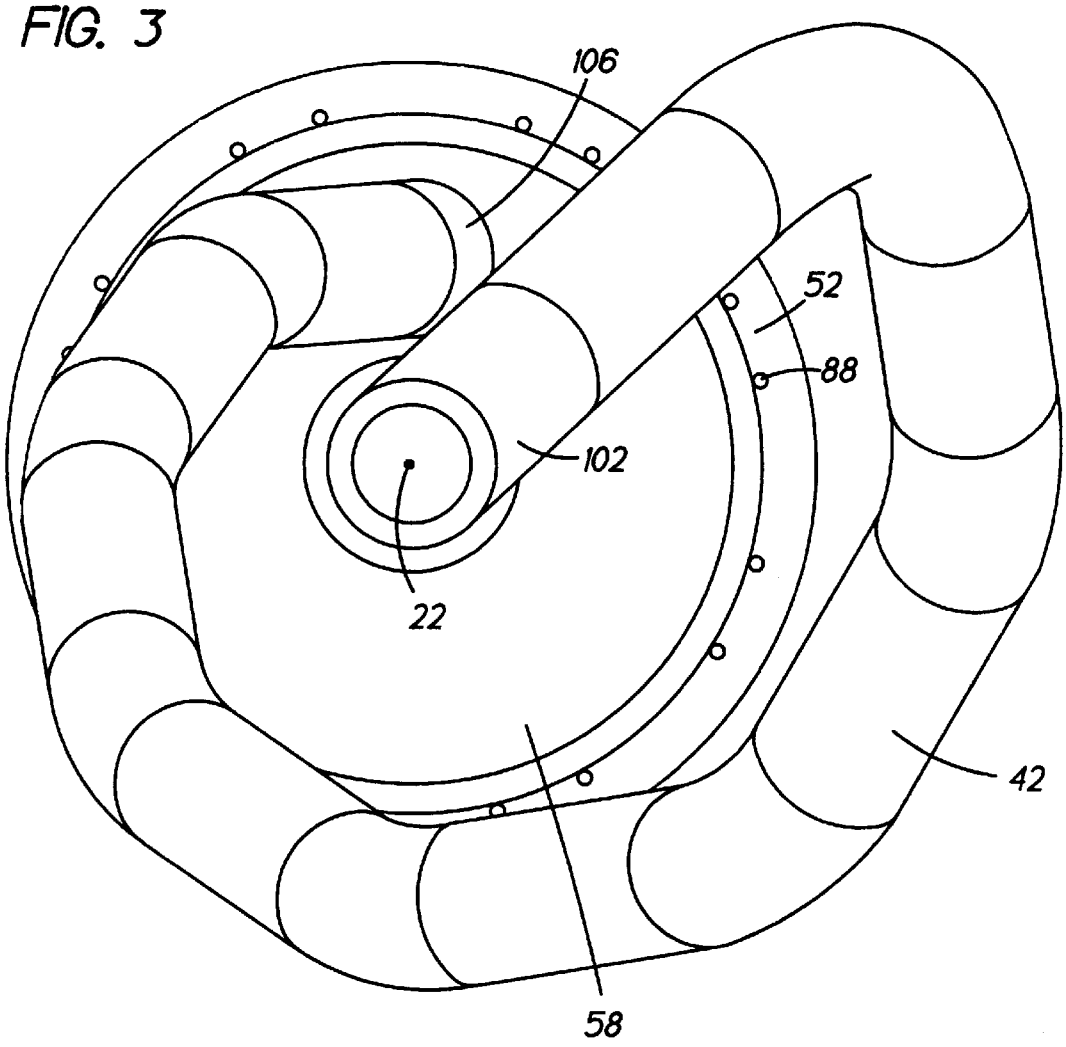
FIG. 3 is a view in the direction 3—3 of FIG. 1 showing the spiral shape of the secondary fuel supply tube.

Referring to FIGS. 1–3, a tangential entry premixing fuel injector 10 includes a forward bulkhead 12, and an aft bulkhead 14 with a fuel-air injection port 16 extending through the aft bulkhead. The injector also includes a scroll assembly 18 comprising a pair of scrolls 18*a,* 18*b* extending between the bulkheads. Each scroll 18*a,* 18*b* is radially offset from fuel injector axis 22 to define a pair of primary air intake slots such as slot 24. Each scroll also includes a primary fuel supply manifold 26 and an axially distributed array of primary fuel injection passages such as representative passages 28.

The injector also includes a centerbody 32 that cooperates with the scrolls to radially bound an annular mixing chamber 34. The centerbody 32 comprises a base 36 a hollow, substantially frustoconical shell 38, a secondary fuel and air injection insert 40 and a secondary fuel supply tube 42. The base 36 has a secondary fuel outlet 44 and is affixed to the forward bulkhead 12. The shell extends axially from the base to define both the radially inner extremity of the mixing chamber 34 and the radially outer extremity of a secondary air supply conduit 46. As seen best in FIG. 2, the insert is comprised of a housing 52 with an integral impingement plate 54, a fluid distributor 56, a plug 58 having a secondary fuel inlet 62 and a tip cap 64. The fluid distributor 56 has a cylindrical central opening 66 and a conical plenum 68. The housing, distributor and plug cooperate to define a fuel distribution chamber 72 and a fuel manifold 74, interconnected by an array of fuel distribution passages 76 in the distributor. Secondary fuel passages 78 in the housing connect the fuel manifold 74 to the engine combustor 82. Similarly, secondary air passages 84, 86, 88 in the impingement plate, tip cap and housing respectively admit secondary air into the combustor. The insert 40 is axially spaced from the base and circumscribed by the aft end of the shell so that the flat, flame anchoring surface 92 of the tip cap is axially aligned with both the trailing edge or lip 94 of the shell and with injector discharge plane 96. The insert is positively secured to the shell by a fluid tight braze joint 98.

The secondary fuel supply tube 42 has an intake end 102 positively secured to the base 36 by a first braze joint 104 to establish fluid communication between the fuel outlet 44 and the supply tube. The tube also has a discharge end 106 positively secured to the insert 40 by a second braze joint 108 to establish fluid communication between the supply tube and the secondary fuel inlet 62 in the plug 58. In principle, one or both of the joints 104, 108 could be a non-positive connection, i.e. a sliding joint, to accommodate dissimilar dimensional changes in the shell 38 and fuel supply tube 42. In practice, however, only a positive connection ensures a fluid tight seal.

The fuel supply tube is a rigid tube configured not only to resist damage arising from engine vibrations, but also to accommodate dissimilar dimensional changes, most notably those induced by disparate thermal response of the shell and the fuel supply tube. These criteria are satisfied by a tube curved in at least two dimensions, the exact nature of the curvature depending in part on the estimated spectrum of vibratory frequencies that the tube will be exposed to during engine operation. The tube is curved so that its natural vibratory frequency, although not as high as that of a straight tube, is significantly greater than any vibratory mode whose energy content is judged to be of concern. The curvature also allows the tube to flex slightly in response to dissimilar dimensional changes.

The tube of the illustrated embodiment is configured for use in an industrial engine manufactured by the assignee of the present application. The tube is made of Inconel 625, has an inside diameter of 0.180 inches, an outside diameter of 0.250 inches, and spans a straight-line distance of approximately 8.2 inches from the fuel outlet 44 to the fuel inlet 62. It was estimated that the tube would be excited by a 450 hz. first order vibratory mode having significant energy content, and by higher order (i.e. higher frequency) modes of lower energy content. Because of the relative energy content of the vibratory modes, only the 450 hz. mode was a cause for concern. Analysis of a number of candidate configurations revealed that a tube approximately 9.7 inches long, coiled in a three dimensional spiral covering approximately one 360° cycle would be suitable. That is, the tube would have a natural frequency of about 540 hz., about 20% above the frequency of concern, and would flex sufficiently to account for the dissimilar dimensional changes of the fuel supply tube and the centerbody shell.

During engine operation a stream of primary combustion air enters the mixing chamber 34 by way of the air intake slots 24. Primary gaseous fuel issues from the fuel passages 28 and enters the incoming airstream. The primary fuel and air enter the mixing chamber, swirl around the centerbody 32 and become intimately intermixed. The swirling fuel-air mixture flows axially through the mixing chamber and the fuel-air injection port 16, and enters the combustor 82 where the mixture is ignited and burned. Concurrently, secondary air enters the secondary air supply tube through holes (not visible in the illustrations) in the centerbody base 36, and flows into the combustor by way of the passages 84, 86, 88.

Meanwhile, secondary gaseous fuel from the fuel supply tube, traverses a path through the fuel distribution chamber 72, fuel distribution passages 76, fuel manifold 74 and secondary fuel passages 78. When the engine is operating, both the primary and secondary air are hot enough to raise the temperature of the centerbody shell to about 900° F. However, the fuel supply tube 42 carries fuel at a temperature of no more than about 200° F. and therefore remains relatively cool. Accordingly, the centerbody expands and contracts axially in response to heat energy transferred into (or out of) the shell. The positive connection 98 between the insert and the shell forces the insert to be correspondingly displaced relative to the base 36. The fuel tube flexes slightly to accommodate this relative displacement.

The above described injector has a number of advantages over the prior art injectors that feature a straight fuel tube and an insert axially supported by the fuel tube and radially supported by the shell without being positively secured to the shell. The absence of relative sliding between the shell and the insert eliminates the possibility of wear and therefore prevents the development of a narrow annulus between the radially outer surface of the insert and the radially inner surface of the shell. As a result, the insert cannot vibrate relative to the shell and overstress joint 104. The absence of the wear annulus also ensures that all of the secondary air is metered through the appropriate passages of the insert, as intended, so that neither exhaust emissions nor flame stability are adversely affected. Moreover, because the position of the insert is invariant relative to the shell, the flame anchoring surface 92 of the insert remains axially aligned with the lip 94 of the shell rather than receding into the shell as the shell expands relative to the tube 42. As a result, the combustion flame remains entirely outside the shell rather than becoming partially recessed into the shell where it could cause severe, heat related damage. Finally, the disclosed arrangement minimizes the likelihood of foreign object damage to the engine since a failure of the fuel supply tube will not liberate the insert. Instead, a far less likely dual failure of both the fuel supply tube and the braze joint 98 would be required to liberate the insert.

Although this invention has been shown and described with reference to a detailed embodiment, it will be understood by those skilled in the art that various changes in form and detail may be made without departing from the invention as set forth in the accompanying claims.

We claim:

1. A premixing fuel injector for a turbine engine, comprising:

a scroll assembly; and a centerbody radially spaced from the scroll assembly and cooperating therewith to define a mixing chamber for mixing a primary fuel with a primary airstream, the centerbody including:

a base having a fuel outlet;

a shell extending axially from the base to define the radially inner extremity of the mixing chamber and the radially outer extremity of a secondary air supply conduit;

an insert having a fuel inlet, the insert being axially spaced from the base, circumscribed by the shell and positively secured to the shell; and a fuel supply tube extending through the conduit and having an intake end and a discharge end, the intake end of the tube being positively secured to the base by a first joint to establish fluid communication between the fuel outlet and the tube, the discharge end of the tube being positively secured to the insert by a second joint to establish fluid communication between the tube and the fuel inlet, the fuel supply tube being curved in at least two dimensions to accommodate dissimilar dimensional changes between the shell and the fuel supply tube.

2. The fuel injector of claim 1 wherein the first and second joints are fluid tight.

3. The fuel injector of claim 1 wherein the fuel supply tube is excited by operational vibrations having an estimated maximum frequency of concern, and the tube is curved so that its natural vibratory frequency is greater than the maximum frequency of concern.

4. The fuel injector of claim 1 wherein the dimensional changes are thermally induced.

5. The fuel injector of claim 1 wherein the tube is curved in three dimensions.

6. The fuel injector of claim 5 wherein the tube is curved in a substantially spiral shape.

7. The fuel injector of claim 6 wherein the spiral shape covers approximately one 360° cycle.

8. A centerbody for a premixing fuel injector, comprising:

a centerbody base having a fuel outlet;

a shell extending axially from the base to define the radially outer extremity of an air supply conduit;

an insert having a fuel inlet, the insert being axially spaced from the base, circumscribed by the shell and positively secured to the shell; and a fuel supply tube extending through the conduit and having an intake end and a discharge end, the intake end of the tube being positively secured to the base by a first joint to establish fluid communication between the fuel outlet and the tube, the discharge end of the tube being positively secured to the insert by a second joint to establish fluid communication between the tube and the fuel inlet, the fuel supply tube being curved in at least two dimensions to accommodate dissimilar dimensional changes between the shell and the fuel supply tube.

9. The centerbody of claim 8 wherein the first and second joints are fluid tight.

10. The centerbody of claim 8 wherein the fuel supply tube is excited by operational vibrations having an estimated maximum frequency of concern, and the tube is curved so that its natural vibratory frequency is greater than the maximum frequency of concern.

11. The centerbody of claim 8 wherein the dimensional changes are thermally induced.

12. The centerbody of claim 8 wherein the tube is curved in three dimensions.

13. The centerbody of claim 12 wherein the tube is curved in a substantially spiral shape.

14. The centerbody of claim 13 wherein the spiral shape covers approximately one 360° cycle.

* * * * *